US007675469B2

(12) United States Patent
Ohba et al.

(10) Patent No.: US 7,675,469 B2
(45) Date of Patent: Mar. 9, 2010

(54) TUNABLE ANTENNA DEVICE AND RADIO APPARATUS

(75) Inventors: Isao Ohba, Tokyo (JP); Satoshi Mizoguchi, Tokyo (JP); Hiromichi Suzuki, Tokyo (JP); Koichi Sato, Tokyo (JP)

(73) Assignee: Kabushiki Kaisha TOSHIBA, Tokyo (JP)

( * ) Notice: Subject to any disclaimer, the term of this patent is extended or adjusted under 35 U.S.C. 154(b) by 0 days.

(21) Appl. No.: 12/001,196

(22) Filed: Dec. 10, 2007

(65) Prior Publication Data

US 2008/0266190 A1 Oct. 30, 2008

(30) Foreign Application Priority Data

Apr. 27, 2007 (JP) ..... 2007-119698

(51) Int. Cl.
*H01Q 1/38* (2006.01)

(52) U.S. Cl. ..... 343/702; 343/833; 343/846; 343/893

(58) Field of Classification Search ..... 343/702, 343/745, 750, 818, 846, 893, 833, 834
See application file for complete search history.

(56) References Cited

U.S. PATENT DOCUMENTS 7,057,573 B2 * 6/2006 Ohira ..... 343/817
7,212,499 B2 * 5/2007 Hoffmann et al. ..... 370/252
7,391,386 B2 * 6/2008 Sawaya et al. ..... 343/833
7,420,513 B2 * 9/2008 Tsutsumi et al. ..... 343/700 MS
2004/0114535 A1 * 6/2004 Hoffmann et al. ..... 370/252
2006/0232492 A1 * 10/2006 Sawatani ..... 343/893

FOREIGN PATENT DOCUMENTS

JP 2006-140662 A 6/2006
JP 2006-270916 A 10/2006
JP 2006-319477 A 11/2006
JP 2006-345042 A 12/2006

* cited by examiner

*Primary Examiner*—Vibol Tan
(74) *Attorney, Agent, or Firm*—Frishauf, Holtz, Goodman & Chick, P.C.

(57) ABSTRACT

An antenna device configured to be fed at a feed portion included in a printed board of a radio apparatus is provided. The antenna device has a feed element connected to the feed portion. The antenna device has a first parasitic element at least a portion of which is arranged close and electrically coupled to at least a portion of the feed element. The first parasitic element is loaded with a first frequency shifter. The antenna device has a second parasitic element at least a portion of which is arranged close and electrically coupled to at least a portion of the feed element. The second parasitic element is loaded with a second frequency shifter.

16 Claims, 4 Drawing Sheets

(PARASITIC ELEMENT 14 IS TUNABLE)

(PARASITIC ELEMENT 13 IS TUNABLE)

TUNABLE ANTENNA DEVICE AND RADIO APPARATUS

CROSS REFERENCE TO RELATED APPLICATIONS

This application is based upon and claims the benefit of priority from the prior Japanese Patent Application No. 2007-119698 filed on Apr. 27, 2007; the entire contents of which are incorporated herein by reference.

BACKGROUND OF THE INVENTION

1. Field of the Invention

The present invention relates to an antenna device and a radio apparatus, and in particular to a tunable antenna device and a radio apparatus including the tunable antenna device.

2. Description of the Related Art

Radio apparatus such as mobile phones are now being used more widely and in a broader range of applications. Some kinds of mobile phones, e.g., may receive digital terrestrial television (TV) broadcasting (DTTB service for mobile phones, so called "1seg" in Japan). While being required to be small sized of less thickness, such a radio apparatus, e.g., a mobile phone, needs to cope with more limited component mounting space as being used for multiple applications.

In above circumstances, a radio apparatus needs an antenna device simultaneously satisfying requirements of a smaller size and a broader frequency band (e.g., 470-770 megahertz (MHz) for receiving DTTB) which are likely to conflict. Possible solutions to the above need are disclosed in Japanese Patent Publication of Unexamined Applications (Kokai), No. 2006-140662, No. 2006-270916, No. 2006-319477 and No. 2006-345042.

More specifically, an antenna disclosed in JP 2006-140662 is formed by a main portion composed of dielectric or magnetic material and two radiation conductors wound around the main portion. The radiation conductors are connected in series through a switch. One of the radiation conductors is on a feeder side and is loaded with variable capacitors on every other turn. The antenna of JP 2006-140662 may change a resonant frequency between a VHF band and a UHF band.

An antenna disclosed in JP 2006-270916 is formed by a stick-like shaped piece of dielectric or magnetic material on which a linear conductor pattern is formed. An inductor portion and a frequency adjusting portion are arranged between an end of the conductor pattern and a grounded conductor, and the end is configured to be fed. The antenna of JP 2006-270916 may be tuned in the 470-770 MHz frequency band by adjustment of a variable capacitor included in the frequency adjusting portion.

An antenna disclosed in JP 2006-319477 includes a radiation element configured to cover a frequency band for mobile phones and the frequency band for DTTB. The radiation element is connected to a feeding point through an inductive element, a tuning circuit and a filter. The antenna of JP 2006-319477 includes a parasitic element arranged close and coupled to the radiation element, and connected to the above feeding point through another filter. The antenna of JP 2006-319477 configured as described above may be used as a Tunable antenna not only for a mobile phone but also for receiving DTTB.

An antenna disclosed in JP 2006-345042 is formed by two transmission lines having a common feeder end and each of which is shorter than a quarter wavelength of a used frequency. Another end of one of the transmission lines is grounded, and another end of another one of the transmission lines is grounded through a variable capacitor element. The antenna of JP 2006-345042 has a resonant frequency that may be controlled by adjustment of the variable capacitor element.

The antennas described above may be tuned to a frequency in the frequency band for DTTB, or may be switched over between use for receiving DTTB and use for mobile communication.

As technologies of digital image recording such as an application of recording digital TV broadcasting, meanwhile, has made a progress, a small-sized radio apparatus such as a mobile phone may be equipped with a function of recording digital images (moving pictures, in particular). It is generally true that a fixed TV set has two tuners for receiving digital TV broadcasting to be simultaneously used, one of which is for watching a program on a channel and another one of which is for recording a competing program on another channel. On this occasion, each of the tuners may have and feed an own antenna.

A small-sized radio apparatus such as a mobile phone may similarly be equipped with a function of recording a competing program. It is difficult for such a small-sized radio apparatus, however, to have plural antennas each of which is individually fed, as mounting space is strictly limited in comparison with the fixed TV set. Thus, such a radio apparatus may need an antenna configured to be not only tuned to a frequency in a broad frequency band but also individually tuned to each of plural frequencies. It is obvious that none of the antennas of JP 2006-140662 and so on described above may meet the above need.

SUMMARY OF THE INVENTION

Accordingly, an object of the present invention is to provide an antenna device that may be mounted on a small-sized radio apparatus and may be tuned to each of plural frequencies individually.

To achieve the above object, according to one aspect of the present invention, an antenna device configured to be fed at a feed portion included in a printed board of a radio apparatus is provided. The antenna device has a feed element connected to the feed portion. The antenna device has a first parasitic element at least a portion of which is arranged close and electrically coupled to at least a portion of the feed element. The first parasitic element is loaded with a first frequency shifter. The antenna device has a second parasitic element at least a portion of which is arranged close and electrically coupled to at least a portion of the feed element. The second parasitic element is loaded with a second frequency shifter.

DETAILED DESCRIPTION OF THE INVENTION

Figure 1:
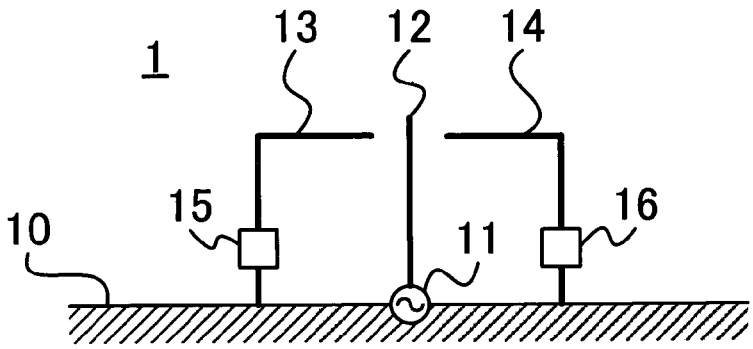
FIG. 1 is an explanatory diagram of an antenna device of an embodiment of the present invention.

An embodiment of the present invention will be described with reference to FIGS. 1-9. FIG. 1 is an explanatory diagram of an antenna device 1 of the embodiment of the present invention showing a configuration of the antenna device 1. The antenna device 1 includes a feed element 12 connected to a feed portion 11 on a printed board 10 that has a ground portion. The antenna device 1 includes a parasitic element 13 and a parasitic element 14. Each of the parasitic elements 13 and 14 is arranged close and electrically coupled to at least a portion of the feed element 12. The feed portion 11 is provided for radio transmission or reception of an apparatus (not shown) containing the printed board 10.

Figure 2A:
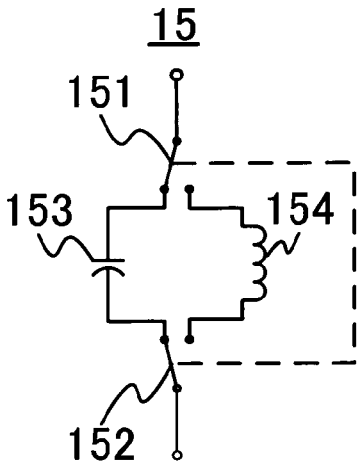
FIGS. 2A-2C are schematic diagrams showing plural examples of how a frequency shifter of the antenna device of the embodiment is formed.
Figure 2B:
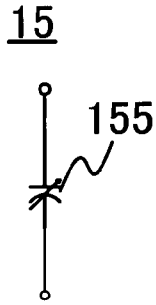
Figure 2C:
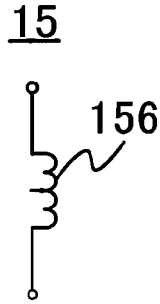

The parasitic element 13 is loaded with a frequency shifter 15. The parasitic element 14 is loaded with a frequency shifter 16. The frequency shifters 15 and 16 are formed by having a reactance element or a switch element of a variable or fixed value. FIGS. 2A-2C are schematic diagrams showing plural examples of how the frequency shifter 15 is formed. The frequency shifter 16 may be similarly formed.

As shown in FIG. 2A, the frequency shifter 15 may have a pair of switches 151 and 152 that may be switched together, a fixed capacitor 153 and a fixed inductor 154. As the switches 151 and 152 may be switched over together (as shown by a dashed line in FIG. 2A), the parasitic element 13 may be loaded with either one of the capacitor 153 and the inductor 154. If an end of the parasitic element 13 is grounded and the frequency shifter 15 is arranged close to a ground portion, as described later, the switch 152 may be omitted and ground sides of the capacitor 153 and the inductor 154 may be directly grounded.

The parasitic element 13 has an own resonant frequency Determined by a whole length thereof, and may change the resonant frequency by being loaded with a reactance element such as the capacitor 153 or the inductor 154. Thus, the antenna device 1 may Select one of two values of the resonant frequency of the parasitic element 13 by switching the switches 151 and 152 over. The antenna device 1 may have more options of the resonant frequency by having more reactance elements of different values and increasing stages of the switches (or using multiple stage switches).

As shown in FIG. 2B, the frequency shifter 15 may have a variable capacitor 155. The antenna device 1 may select the resonant frequency of the parasitic element 13 by adjusting a capacitance value of the capacitor 155.

As shown in FIG. 2C, the frequency shifter 15 may have a variable inductor 156. The antenna device 1 may select the resonant frequency of the parasitic element 13 by adjusting an inductance value of the inductor 156.

Thus, the antenna device 1 may be tuned to one of two Frequencies individually by operating or adjusting the switches or the variable elements of the frequency shifters 15 and 16 configured, e.g., as shown in one of FIGS. 2A-2C.

Figure 3:
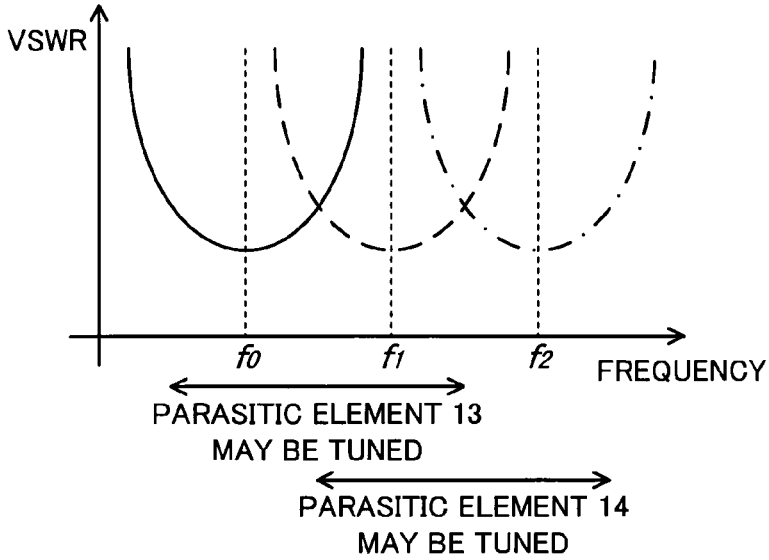
FIG. 3 is an explanatory diagram showing how a range of a variable (tunable) resonant frequency of a parasitic element of the antenna device of the embodiment should be determined.

FIG. 3 is an explanatory diagram showing how a range of the variable (tunable) resonant frequency of the parasitic element 13 or 14 should be determined. FIG. 3 has a horizontal axis representing a frequency and a vertical axis representing a voltage standing wave ratio (VSWR) of the antenna device 1, e.g., at the feed portion 11.

If the frequency shifters 15 and 16 are configured, e.g., as shown in FIG. 2A, the capacitor 153 and the inductor 154 of the frequency shifter 15 may be given values in such a way that the parasitic element 13 may select a frequency f0 or f1 shown in FIG. 3 as the resonant frequency. Similarly, the elements of the frequency shifter 16 may be given values in such a way that the parasitic element 14 may select f1 or a frequency f2 shown in FIG. 3 as the resonant frequency. The range of the variable resonant frequency of the parasitic element 13 and the range of the variable resonant frequency of the parasitic element 14 may thereby at least partially overlap.

Assume that the ranges of the variable resonant frequencies of the parasitic elements 13 and 14 do not overlap, and that although the parasitic element 13 may select f0 or f1 as the resonant frequency, the parasitic element 14 may only select f2 as the resonant frequency. If that is the case, the antenna device 1 may be tuned to a pair of the frequencies f0 and f2 or to a pair of the frequencies f1 and f2, but may not be tuned to a pair of the frequencies f0 and f1.

If the parasitic element 14 may select f1 or f2 as the resonant frequency, meanwhile, the antenna device 1 may be tuned to a pair of the frequencies f0 and f1, in addition to the pair of f0 and f2 and the pair of f1 and f2. That is, the antenna device 1 may increase options for combination of frequencies to which the antenna device 1 may be tuned by making the ranges of the variable resonant frequencies of the parasitic elements 13 and 14 at least partially overlap. The antenna device 1 may similarly increase the above options by using a multiple-stage switch or a variable element for the frequency shifters 15 and 16, and thereby further increasing options of the resonant frequency of each of the parasitic elements 13 and 14.

It is disadvantageous in terms of manufacturing cost, though, to make the range where the resonant frequencies of the parasitic elements 13 and 14 overlap excessively broad. If that is the case, the frequency shifters 15 and 16 may need more stages of the switch, more fixed elements and a broader variation range of the variable element. It is preferable to select the overlap range keeping a balance between a variety of the combination of frequencies to which the parasitic elements 13 and 14 may be simultaneously tuned and the manufacturing cost.

As shown in FIG. 1, the parasitic element 13, particularly an end thereof, is arranged close to an open end of the feed element 12. If the feed element 12 is excited, a relatively high electric field is distributed at and around the open end of the feed element 12. Another end of the parasitic element 13 is connected to the ground portion of the printed board 10 so that the parasitic element 13 is grounded. The parasitic element 14, particularly an end thereof, is arranged close to the open end of the feed element 12. Another end of the parasitic element 14 is connected to the ground portion.

That is, in the configuration shown in FIG. 1, the parasitic Element 13 is voltage coupled to the feed element 12. If not being loaded with the frequency shifter 15, the parasitic element 13 is resonant at a frequency where a quarter wavelength corresponds to a whole length thereof, and so is the parasitic element 14 if not being loaded with the frequency shifter 16.

While the parasitic element 13, particularly the one end thereof, is arranged close to the feed element 12, the other end of the parasitic element 13 may be open-ended. If that is the case, the parasitic element 13 is voltage coupled to the feed element 12. If not being loaded with the frequency shifter 15, the parasitic element 13 is resonant at a frequency where a half wavelength corresponds to a whole length thereof, and so is the parasitic element 14 if not being loaded with the frequency shifter 16.

The grounded end of the parasitic element 13 may be arranged close to the feed portion 11 so that the parasitic element 13 is current coupled to the feed element 12. On this occasion, if not being loaded with the frequency shifter 15, the parasitic element 13 is resonant at a frequency where a quarter wavelength corresponds to a whole length thereof, and so is the parasitic element 14 if not being loaded with the frequency shifter 16.

The parasitic elements 13 and 14 each may be coupled to the feed element 12 in any form described above that may be different from each other.

The frequency shifters 15 and 16 need a control line (not shown in FIG. 1) connected thereto for opening or closing the switches and adjusting the variable elements. As being equivalent to a ground conductor line at radio frequencies, such a control line may affect characteristics of the antenna device 1 if being drawn far from the ground portion. It is thus preferable to arrange the frequency shifters 15 and 16 close to the ground portion.

Figure 4:
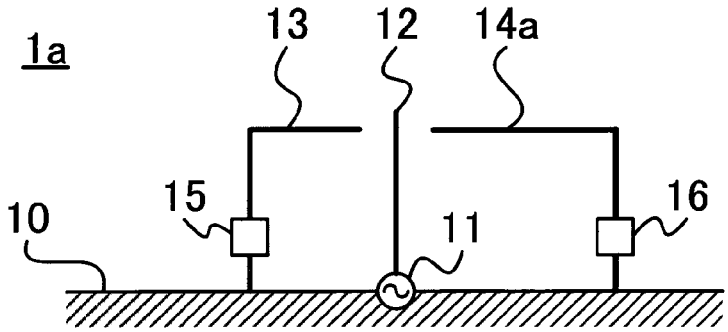
FIG. 4 is an explanatory diagram of an antenna device of a modification of the embodiment.

FIG. 4 is an explanatory diagram of an antenna device 1*a* of a modification of the embodiment of the present invention showing a configuration of the antenna device 1*a*. The antenna device 1*a* includes a parasitic element 14*a* that is not equally long with the parasitic element 13, instead of the parasitic element 14 of the antenna device 1. Each of other portions of the antenna device 1*a* is a same as the corresponding one of the antenna device 1 having a same reference numeral. Even if the parasitic element 14 is not equally long with the parasitic element 13, as shown in FIG. 4, the antenna device 1*a* may have a same effect as an effect of the antenna device 1 by individual adjustment of the frequency shifters 15 and 16.

Figure 5:
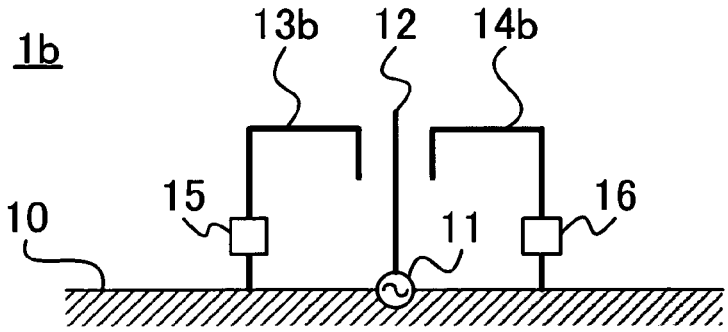
FIG. 5 is an explanatory diagram of an antenna device of Another modification of the embodiment.

FIG. 5 is an explanatory diagram of an antenna device 1*b* of another modification of the embodiment of the present invention showing a configuration of the antenna device 1*b*. The antenna device 1*b* includes a parasitic element 13*b* a portion of which is arranged almost parallel to the feed element 12 and a parasitic element 14*b* a portion of which is arranged almost parallel to the feed element 12, instead of the parasitic elements 13 and 14 of the antenna device 1. Each of other portions of the antenna device 1*b* is a same as the corresponding one of the antenna device 1 having a same reference numeral.

The antenna device 1*b* may have an effect that the feed element 12 and the parasitic element 13*b* or 14*b* are strongly coupled to each other by arranging, as shown in FIG. 5, the portion of the parasitic element 13*b* or 14*b* almost parallel and close to the feed element 12. The antenna device 1*b* may have a pair of the parasitic elements 13*b* and 14, or 13 and 14*b*, instead of the pair of the parasitic elements 13 and 14 shown in FIG. 1 or the pair of the parasitic elements 13*b* and 14*b* shown in FIG. 5.

Figure 6:
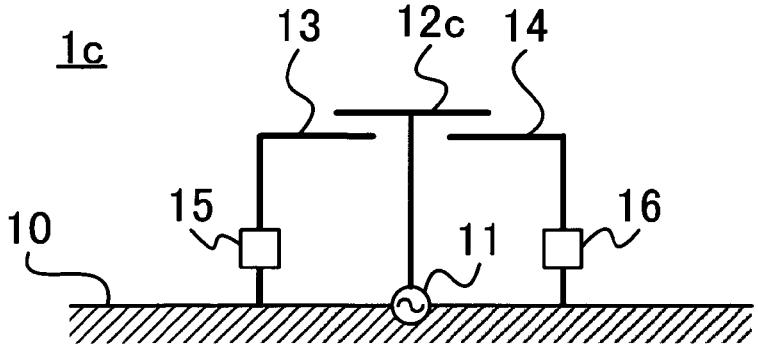
FIG. 6 is an explanatory diagram of an antenna device of still another modification of the embodiment.

FIG. 6 is an explanatory diagram of an antenna device 1*c* of still another modification of the embodiment of the present invention showing a configuration of the antenna device 1*c*. The antenna device 1*c* includes a feed element 12*c* with a T-branch on an open end thereof, instead of the feed element 12 of the antenna device 1. Each of other portions of the antenna device 1*c* is a same as the corresponding one of the antenna device 1 having a same reference numeral. Each of the parasitic elements 13 and 14 is arranged in such a way that a portion including the open end is almost parallel and close to a portion of the T-branch of the feed element 12.

The antenna device 1*c* may have an effect that the feed element 12*c* and the parasitic element 13 or 14 are strongly coupled to each other by arranging, as shown in FIG. 6, the portion of the parasitic element 13 or 14 almost parallel and close to the portion of the feed element 12*c*. The T-branch of the feed element 12*c* need not be symmetric on both sides of a branching portion. The T-branch of the feed element 12*c* may be arranged almost parallel and close to a portion of either one of the parasitic elements 13 and 14.

Figure 7:
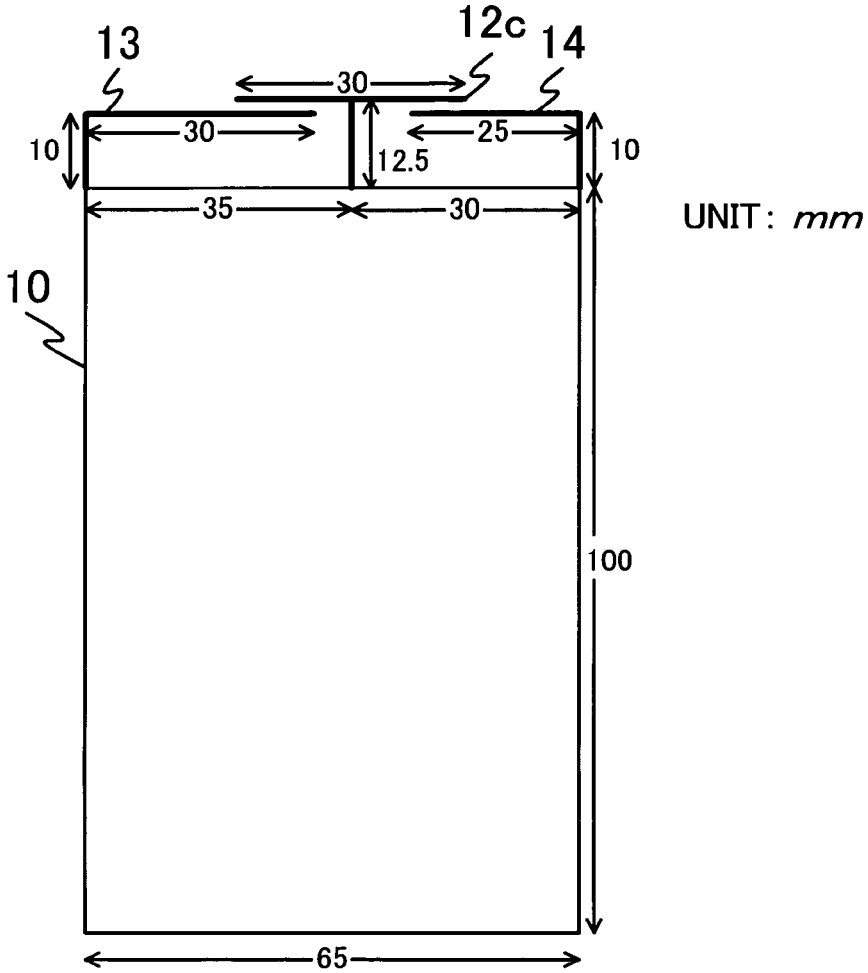
FIG. 7 is a plan view of an estimated model used for simulation estimating a VSWR-frequency characteristic of one of the embodiment and the modifications.

A VSWR-frequency characteristic of one of the above embodiment and the modifications has been estimated by simulation, and estimated results will be described with reference to FIGS. 7-9. FIG. 7 is a plan view of an estimated model used for the simulation showing a configuration and a size of the estimated model. As the estimated model is based on the antenna device 1*c* shown in FIG. 6, each portion of the estimated model has a same reference numeral as the corresponding one shown in FIG. 6. A dimension of each of the portions is in millimeters (mm).

The printed board 10 of the estimated model is 100 mm high and 65 mm wide. The feed element 12*c* is arranged on an upper short side of the printed board 10 and may be fed at a feeding portion (not shown) provided on the upper short side. The parasitic elements 13 and 14 are arranged on both ends of the upper short side and grounded. Each of the parasitic elements 13 and 14 is arranged in such a way that a portion including the open end is almost parallel and close to a portion of the T-branch of the feed element 12.

Figure 8:
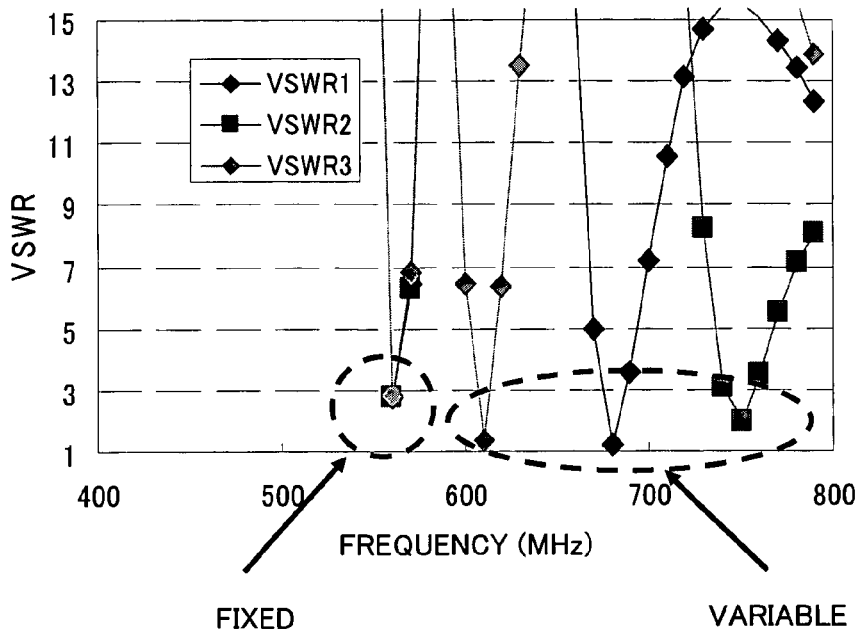
FIG. 8 is a graph of the VSWR-frequency characteristic of the estimated model in which one of the parasitic elements is loaded with a frequency shifter.

FIG. 8 is a graph of the VSWR-frequency characteristic of the estimated model in which the parasitic element 14 is loaded with the frequency shifter 16 shown in FIG. 6 and is made tunable thereby. In FIG. 8, plots shown as "fixed" on a left side around 570 MHz are based on a resonance characteristic of the parasitic element 13. Plots shown as "variable" from a center to a right side between 600 and 800 MHz are based on a resonance characteristic of the parasitic element 14 which may be tuned to one of three resonant frequencies.

Figure 9:
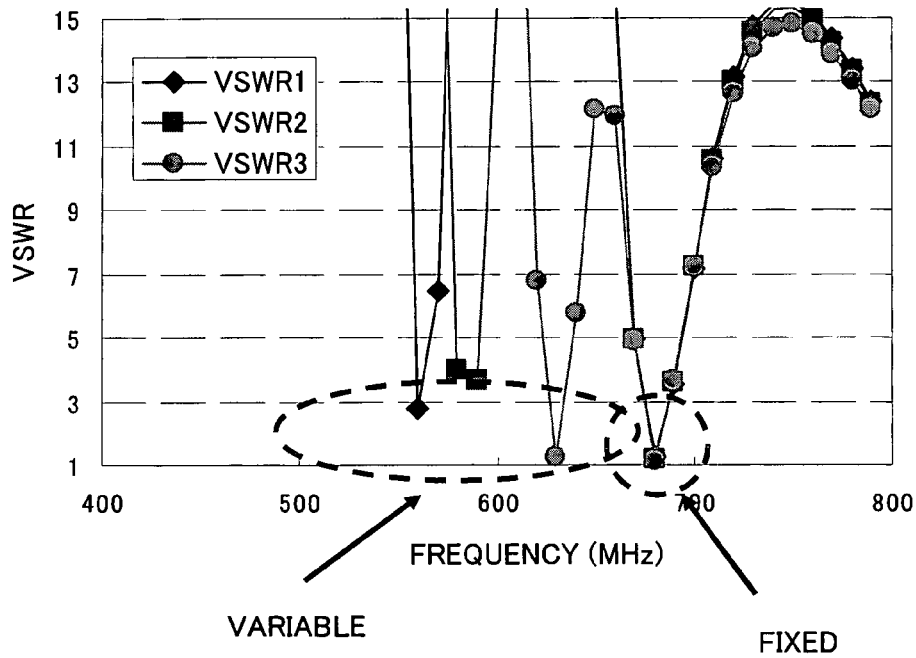
FIG. 9 is a graph of the VSWR-frequency characteristic of the estimated model in which another one of the parasitic elements is loaded with a frequency shifter.

FIG. 9 is a graph of the VSWR-frequency characteristic of the estimated model in which the parasitic element 13 is loaded with the frequency shifter 15 shown in FIG. 6 and is made tunable thereby. In FIG. 9, plots shown as "fixed" on a right side around 680 MHz are based on the resonance characteristic of the parasitic element 14. Plots shown as "variable" from a center to a left side between 560 and 650 MHz are based on the resonance characteristic of the parasitic element 13 which may be tuned to one of three resonant frequencies.

As shown in FIG. 8, and also in FIG. 9, the tuned frequency may be individually selected on the basis of the resonance characteristic of each of the parasitic elements 13 and 14.

According to the embodiment and the modifications described above, the antenna device that may be mounted on a small-sized radio apparatus may be individually tuned to one of plural frequencies by loading each of the plural parasitic elements arranged close to the feed element with the frequency shifter and adjusting the tuned frequency individually.

In the above description of the embodiment and the modifications, the configurations, shapes, dimensions, connections or positional relations of the antenna devices, the frequency values, etc. are considered as exemplary only, and thus may be variously modified within the scope of the present invention.

The particular hardware or software implementation of the present invention may be varied while still remaining within the scope of the present invention. It is therefore to be understood that within the scope of the appended claims and their equivalents, the invention may be practiced otherwise than as specifically described herein.

What is claimed is:

1. An antenna device configured to be fed at a feed portion included in a printed board of a radio apparatus, the antenna device comprising:

a feed element connected to the feed portion;

a first parasitic element having a first end portion and a second end portion, the first end portion being arranged closer to at least a portion of the feed element than the second end portion so as to be electrically coupled to the feed element, the first parasitic element being loaded with a first frequency shifter so that a resonant frequency of the first parasitic element is rendered variable; and a second parasitic element having a third end portion and a fourth end portion, the third end portion being arranged closer to at least a portion of the feed element than the fourth end portion so as to be electrically coupled to the feed element, the second parasitic element being loaded with a second frequency shifter so that a resonant frequency of the second parasitic element is rendered variable.

2. The antenna device of claim 1, wherein the first frequency shifter and the second frequency shifter each include one of a switch element and a reactance element of one of a variable value and a fixed value.

3. The antenna device of claim 1, wherein the first frequency shifter and the second frequency shifter each include one of a switch element and a reactance element of one of a variable value and a fixed value, the reactance element being given a value in such a way that a range of a variable resonant frequency of the first parasitic element and a range of a variable resonant frequency of the second parasitic element may at least partially overlap.

4. The antenna device of claim 1, wherein the first end portion is arranged close to a portion of the feed element at and around which a relatively high electric field is distributed upon being excited, and the second end portion is grounded.

5. The antenna device of claim 1, wherein the first end portion is arranged close to a portion of the feed element at and around which a relatively high electric field is distributed upon being excited, and the second end portion is open-ended.

6. The antenna device of claim 1, wherein the second end portion is grounded and arranged close to the feed portion.

7. The antenna device of claim 1, wherein the first end portion is arranged close to a portion of the feed element at and around which a relatively high electric field is distributed upon being excited, and the first frequency shifter is arranged close to a ground portion of the printed board.

8. The antenna device of claim 1, wherein the first end portion is arranged close and almost parallel to at least a portion of the feed element.

9. A radio apparatus, comprising:

a printed board including a feed portion and a ground portion; and an antenna device configured to be fed at the feed portion, the antenna device comprising:

a feed element connected to the feed portion;

a first parasitic element having a first end portion and a second end portion, the first end portion being arranged closer to at least a portion of the feed element than the second end portion so as to be electrically coupled to the feed element, the first parasitic element being loaded with a first frequency shifter so that a resonant frequency of the first parasitic element is rendered variable; and a second parasitic element having a third end portion and a fourth end portion, the third end portion being arranged closer to at least a portion of the feed element than the fourth end portion so as to be electrically coupled to the feed element, the second parasitic element being loaded with a second frequency shifter so that a resonant frequency of the second parasitic element is rendered variable.

10. The radio apparatus of claim 9, wherein the first frequency shifter and the second frequency shifter each include one of a switch element and a reactance element of one of a variable value and a fixed value.

11. The radio apparatus of claim 9, wherein the first frequency shifter and the second frequency shifter each include one of a switch element and a reactance element of one of a variable value and a fixed value, the reactance element being given a value in such a way that a range of a variable resonant frequency of the first parasitic element and a range of a variable resonant frequency of the second parasitic element may at least partially overlap.

12. The radio apparatus of claim 9, wherein the first end portion is arranged close to a portion of the feed element at and around which a relatively high electric field is distributed upon being excited, and the second end portion is grounded.

13. The radio apparatus of claim 9, wherein the first end portion is arranged close to a portion of the feed element at and around which a relatively high electric field is distributed upon being excited, and the second end portion is open-ended.

14. The radio apparatus of claim 9, wherein the second end portion is grounded and arranged close to the feed portion.

15. The radio apparatus of claim 9, wherein the first end portion is arranged close to a portion of the feed element at and around which a relatively high electric field is distributed upon being excited, and the first frequency shifter is arranged close to the ground portion of the printed board.

16. The radio apparatus of claim 9, wherein the first end portion is arranged close and almost parallel to at least a portion of the feed element.

* * * * *